United States Patent [19]

Warshawsky

[11] 4,381,538

[45] Apr. 26, 1983

[54] LAMP SWIVEL

[75] Inventor: Jerome Warshawsky, Baldwin, N.Y.

[73] Assignee: I. W. Industries, Inc., Melville, N.Y.

[21] Appl. No.: 310,445

[22] Filed: Oct. 13, 1981

[51] Int. Cl.[3] ..... F21V 21/26

[52] U.S. Cl. ..... 362/269; 362/287; 362/427; 362/431

[58] Field of Search ..... 362/269, 287, 427, 431

[56] References Cited

U.S. PATENT DOCUMENTS

| | | | |
|---|---|---|---|
| 2,488,898 | 11/1949 | Brasty | 362/427 |
| 3,983,386 | 9/1976 | Schallenkammer | 362/427 |
| 4,247,886 | 1/1981 | Warshawsky | 362/432 |

*Primary Examiner*—Stephen J. Lechert, Jr.

*Attorney, Agent, or Firm*—Stephen E. Feldman; Marvin Feldman; Jules L. Chaboty

[57] ABSTRACT

A lamp swivel composed of two main coaxial members, which are at least partially rotatable relative to each other. An inner pin extends from one member to a circular inner groove in the other member, the groove being coaxial with the members. However, the other member, usually composed of a metal such as brass, copper or aluminum which may be anodized, is coined so as to prevent egress of the pin from the groove. Thus the two members are semi-permanently attached to each other and can rotate, by less than 360 degrees, relative to each other. The invention is especially applicable to provide an articulated lamp mounting for a swing arm lamp or the like, the lamp swivel being a swivel connector or coupling means which provides an articulated mounting attachment for the lamp.

13 Claims, 6 Drawing Figures

LAMP SWIVEL

BACKGROUND OF THE INVENTION

1. Field of the Invention

A lamp swivel for pivotally or rotatably mounting a lamp body to a lamp base, so that the lamp body has an articulated mounting.

2. Description of the Prior Art

Numerous configurations of lamps and other mountings for receiving an electric light bulb, or a fluorescent lamp, are known to the art. With especial regard to electric light bulbs, the usual table, desk or floor lamp includes a socket, having a switch, which is mounted in conjunction with a lamp harp to the body of the lamp, which in may cases extends directly to a lamp base which supports the entire article. The light bulb is screwed into the socket between the arms of the harp, and the lamp shade is suspended from the top of the harp by means of a spider or the like which has a plurality of radial arms. The spider arms radially extend from the center top of the harp to attachment to the upper edge of the lamp shade, so that the shade is suspended from the harp by a cantilever suspension as is commonly understood by those skilled in the art. In the usual conventional lamp configuration, the entire lamp structure must be moved and placed in a different location in order to change the source of light; and the origin of the light, relative to a desk or work table being illuminated, is not easily varied or changed. Swing arm lamps are known in which swivel connectors or coupling means provide an articulated mounting attachment.

Among the prior art relative to lamp swivels and the like may be mentioned U.S. Pat. Nos. 4,175,809; 4,079,969; 4,042,262; 3,983,386; 3,957,331; 3,604,923; 3,022,096; 3,012,798; 2,729,473; 2,887,329; 2,694,585; 2,488,898; 1,609,230 and 1,492,335.

OBJECTS OF THE INVENTION

It is an object of the present invention to provide an improved lamp swivel.

Another object is to provide a lamp swivel such that the lamp mounting is articulated.

A further object is to provide an improved swing arm lamp.

An additional object is to provide an improved lamp swivel connector and coupling means which provides an articulated mounting attachment for the lamp.

An object is to provide a lamp swivel such that the origin or source of light, relative to a desk or work table or the like being illuminated, may be easily varied or changed.

An object is to provide a lamp swivel which is cheaply and easily manufactured in mass production facilities using unskilled labor, and by the use of inexpensive materials of construction, e.g. inexpensive metals such as brass, bronze, copper, steel, aluminum which may be anodized, zinc die castings, etc., or a plastic such as bakelite, polyethylene, polypropylene especially isotactic polypropylene, polyvinyl chloride, nylon, teflon, methyl methacrylate or other acrylic resin, ABS, etc.

Yet another object is to provide lamp swivel for a cantilever suspension of a lamp body.

These and other objects and advantages of the present invention will become evident from the description which follows.

BRIEF DESCRIPTION OF THE INVENTION

The present invention basically entails the provision of a lamp swivel which is mountable between a lamp base and a lamp body, so that the lamp body together with its associated light-generating means may be swivelably pivoted and rotated on linear support means and about an axis. This axis is the principal axis of the lamp swivel, and as will appear infra, both main members of the lamp swivel are coaxial with this principal axis.

The present lamp swivel basically includes a first member and a second member. The first member has a first central axis, and the second member has a second central axis. Typically, the first and second central axes are coaxial with the aforementioned principal axis. The first member is characterized by the provision of a main body disposed along the first central axis, and a cylindrical extension which depends from the main body of the first member. The extension is generally coaxial with the first central axis, and as mentioned supra the first central axis will generally lie along the principal axis. The first member body is provided with means to receive one end of the aforementioned linear support means. This linear support means extends from the one end to an other end connection to the lamp body.

Pin means extends laterally outwards from the outer surface of the extension portion of the first member. Typically, the pin means basically includes a pin per se, together with the provision of a lateral pocket in the outer surface of the extension portion of the first member. The pin is detachably insertable into the pocket. Alternatively, the pin means can be an integral male protrusion or protuberance, or a discrete pin which is pressed into the pocket for semi-permanent installation. Typically the pin is cylindrical and the pocket is circular, and the pin is coaxially insertable into the pocket.

The lamp swivel device and article of manufacture is completed in its most general configuration by the provision of a second member having a central axis generally designated herein as a second central axis. The second member has a body disposed along the second central axis. One end of this second member body has a cylindrical recess which is coaxial with the second central axis. The cylindrical recess has a diameter which is slightly greater than the diameter of the aforementioned cylindrical extension of the first member, so that the extension is contiguously insertable into the recess.

The lateral surface of the recess has a slot and a circular groove. This surface slot extends from one end of the second member body to the circular groove in the surface of the recess. The groove is coaxial with the second central axis, so that when the extension is inserted into the recess, at least a portion of the first central axis is coaxial with the second central axis.

The pin means then is receivable through the slot and into the groove, so that the first member is detachably attached to the second member, and so that the first, member is at least partially rotatable about its first central axis while the second member either remains stationary or concomitantly rotates about its second central axis, which as mentioned lies along the principal axis. Finally, the second member body is detachably attachable to a means, such as a lamp post or rod, this means extending to the lamp base.

Typically, in a preferred embodiment, the first and second members are cylindrical and coaxial. It is preferred that the linear support means and the means extending to the lamp base each are laterally detachably receivable in and attachable to their respective first or second members. It is also preferred that the means in the first member body to receive one end of the linear support means, and the detachable attachment of the means extending to the lamp base, each include a threaded cylindrical recess or opening in the respective first or second member body. In this case, typically each recess or opening extends laterally into the respective first or second member body.

In other preferred embodiments, and usually, the lamp body includes a lamp harp, a lampshade mounted to the lamp harp, and light-generating means, such as an electric-light bulb and socket, also mounted to the lamp harp. The light bulb is of course receivable into the socket.

Typically, the outer surface portion of the second member body at or adjacent to the junction of the slot and the groove is coinable, i.e. composed of a coinable metal or alloy such as brass, bronze, copper, an aluminum alloy, a zinc alloy, a nickel alloy, stainless steel or wrought iron, so that when the pin means is inserted through the slot and into the groove, and the first member is rotated relative to the second member, so as to displace the pin means away from the slot, then the aforementioned outer surface portion is coinably stampable inwards, so that the pin means then cannot again be channeled by manipulation through the slot, and is permanently disposed in the groove. Thus, the first and second members are permanently attached to each other, and rotatable relative to each other by less than 360 degrees, about the aforementioned principal axis.

Finally, in a preferred embodiment, each of the first and second members is provided with a central cylindrical through opening, each of these openings being coaxial with the respective member, with at least a portion of each of these openings being threaded.

Thus in summary, the present invention provides a lamp swivel composed of two main coaxial members, which are at least partially rotatable relative to each other. An inner pin extends from one member to a circular inner groove in the other member, the groove being coaxial with the members; however, the other member, usually composed of a metal such as brass, copper or aluminum which may be anodized, is coined so as to prevent egress of the pin from the groove. Thus the two members are semi-permanently attached to each other and can rotate, by less than 360 degrees, relative to each other. The invention is especially applicable to provide an articulated lamp mounting for a swing arm lamp or the like, the lamp swivel being a swivel connector or coupling means which provides an articulated mounting attachment for the lamp.

The invention accordingly consists in the features of construction, combination of elements and arrangement of parts which will be exemplified in the device and article of manufacture hereinafter described, and of which the scope of application is as elucidated supra and as will be indicated in the appended claims.

BRIEF DESCRIPTION OF THE DRAWINGS

In the accompanying drawings in which is shown one of the various possible embodiments of the invention.

DETAILED DESCRIPTION OF THE PREFERRED EMBODIMENTS

Figure 1:
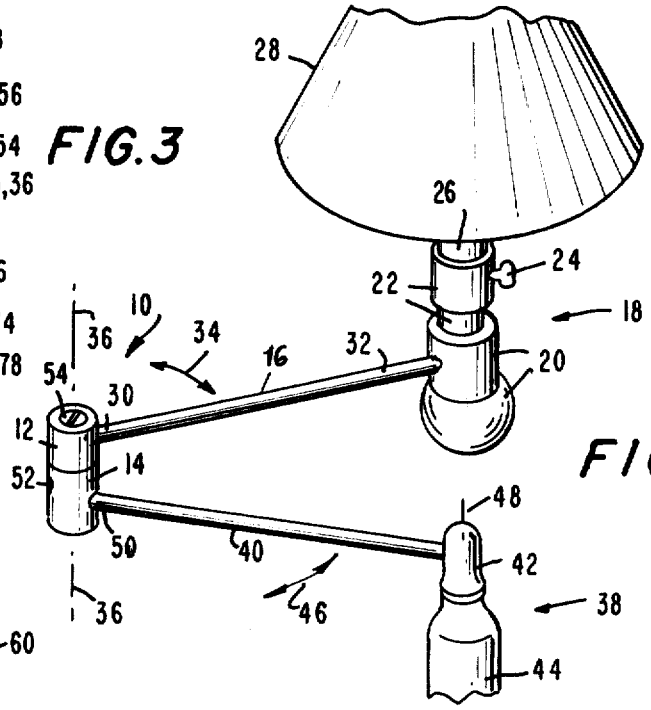
FIG. 1 is an overall perspective view of the present lamp swivel as installed between two lamp rods or posts which connect the lamp swivel to, respectively, a lamp body or socket, and a lamp base.

Referring now to FIG. 1, the present lamp swivel 10 includes an upper first member 12 and a lower second member 14. Linear support means 16, consisting in this case of a generally horizontally oriented lamp rod or post, extends between the upper member 12 of the lamp swivel 10 and a lamp body 18. The lamp body 18 may be of any suitable configuration and including an associated light-generating means, thus, in this case, the lamp body 18 includes a lower main body portion 20 into which a lamp socket 22 having a switch 24 is receivable, an electric light bulb 26, and a lampshade 28 mounted in this case directly to the bulb 26.

One end 30 of the lamp rod or post 16 is received in the first member body 12, and the other end 32 of the member 16 is connected to the main body portion 20 of the lamp body 18. Thus, as will appear infra, the entire lamp body 18 assemblage is horizontally rotatable, as indicated by the doubleheaded arrow 34, about the vertical axis 36. In other words, the lamp body 18 together with its associated light-generating means 26 may be horizontally swivelably pivoted and rotated on the horizontal linear support means 16 and about the vertical axis 36, which axis 36 constitutes the principal axis of the lamp swivel, as will appear infra.

FIG. 1 also shows a lamp base 38, which is mounted or supported on a fixed or semi-permanent support such as a floor, a table, a shelf, a desk, or the like, not shown. Means 40, consisting in this case of a linear support means, i.e. a generally horizontally oriented lamp rod or post, extends between the lower member 14 of the lamp swivel 10 and the upper portion 42 of the lamp base 38, which is horizontally pivotable relative to the stationary lower portion 44 of the lamp base 38, so that the second member 14, which may remain stationary in practice, may alternatively be concomitantly rotated about its axis, e.g. the principal axis 36, as will appear infra and as indicated by the double headed arrow 46; or, in most instances, second member 14 when rotated will rotate about central axis 48 of the lamp base 38. As will appear infra, one end 50 of the lamp rod or post 40 is detachably attached to the lower member 14, the member 40 constituting a means which extends from the second member 14 to the lamp base 38. FIG. 1, which constitutes the fully assembled lamp swivel 10, also shows the coined section 52 of the lower member 14, as well as a threaded cylindrical plug 54 which extends into a threaded top opening in upper member 12.

Figure 3:
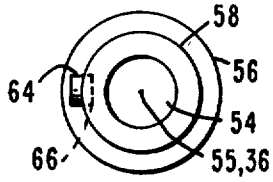
FIG. 3 is a bottom plan view of the upper portion of the lamp swivel of FIG. 2, taken substantially along the line 3—3 of FIG. 2.
Figure 4:
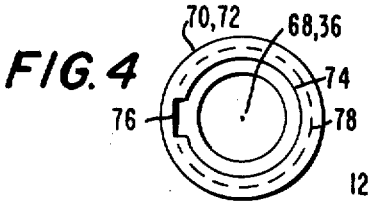
FIG. 4 is a top plan view of the lower portion of the lamp swivel of FIG. 2, taken substantially along the line 4—4 of FIG. 2.
Figure 2:
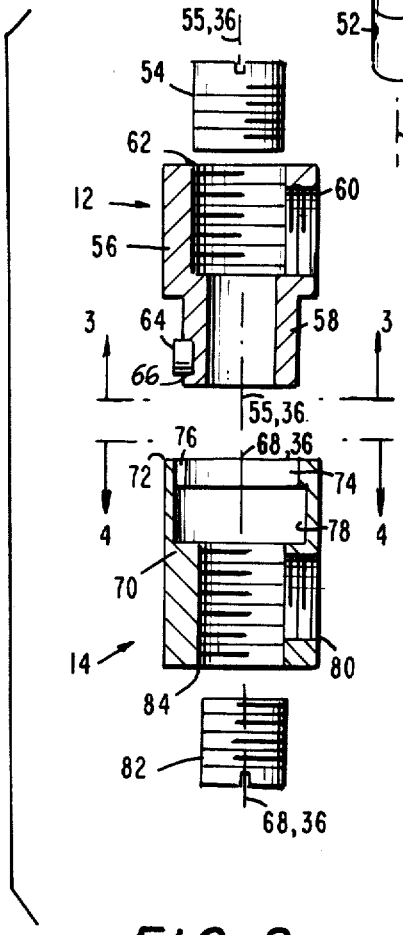
FIG. 2 is an exploded sectional elevation view of the present lamp swivel.

Referring now to FIGS. 2, 3, and 4, salient details and elements of the lamp swivel are shown. With regard first to the upper member 12, this member 12 is characterized by having a central axis 55 which is aligned along the central axis 36, with a cylindrical body portion 56 being disposed along the axis 55. A cylindrical extension 58 depends coaxially from the body 56, and the axis 55 of the extension 58 is coaxial with the main or principal axis 36 of the lamp swivel 10, as shown. The first member body 56 is provided with a lateral threaded recess or socket 60 to receive the end 30 of the linear support means 16, as well as an upper threaded recess or socket 62 to receive the plug 54; the recess or socket 62 being coaxial with the axis 55 and the principal axis 36. A cylindrical pin 64 constituting a pin means extends laterally outwards from the outer surface of the extension 58; in this case, pin 64 is mounted in and extends outwards from a circular pocket or recess 66 in the outer surface of the extension 58. The pin 64 is detachably insertable into the pocket 66, and the typically cylindrical pin 64 is usually coaxially inserted into the generally circular pocket 66.

With regard now to the lower member 14, this member 14 is characterized by having a central axis 68 which is aligned along the central axis 36, so that the main or principal axis 36 of the lamp swivel 10 is coaxial with both axes 55 and 68, and so that the cylindrical body 70 of the second or lower member 14 is disposed along the second central axis 68. One end 72 of the lower member body 70, in this case the upper end as shown, is provided with a cylindrical recess 74. This body recess 74 is coaxial with the axes 68 and 36 and, as shown, the recess 74 has a diameter slightly greater than the diameter of the extension 58, so that the extension 58 is contiguously insertable into the recess 74, as best seen in FIG. 5.

As best shown in FIG. 2, the lateral inner surface of the recess 74 is provided with a slot 76 and a circular groove 78. The inner surface slot 76 extends from the one end 72 of the body 70 of the lower second member 14, to the circular groove 78 in the surface of the recess 74. The groove 78 is coaxial with the axes 68 and 36. Thus, as best seen in FIG. 5, when the extension 58 is inserted, either by manipulation or mechanically, into the recess 74, at least a portion of the first central axis 55 is coaxial with the second central axis 68. The pin means 64 is then concomitantly receivable through the slot 76 and into the groove 78, so that the first or upper member 12 is detachably attached to the second or lower member 14, as shown in FIG. 5. This FIG. 5 shows how the pin means 64 is receivable in, and rides in the groove 78, when the first member 12 is at least partially rotated about the main or principal axis 35, which in FIG. 5 concurs with the first central axis 55, while the second member 14 either remains stationary or concomitantly rotates about the second central axis 68, which lies along and concurs with the principal axis 36.

The body 70 of the second or lower member 14 is detachably attached via lateral threaded recess or socket 80 to the end 50 of the lamp post or rod 40 which extends to the lamp base 38. In addition, a bottom plug 82 is screwed into a lower threaded recess or socket 84 in the bottom of the body 70.

Figure 5:
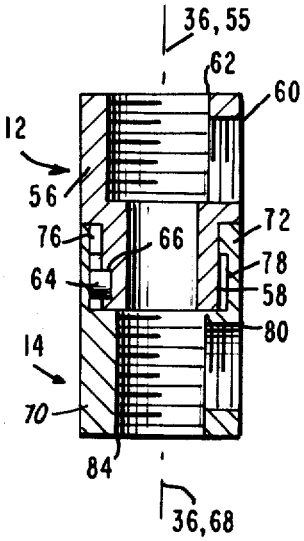
FIG. 5 shows the assembled lamp swivel in a sectional elevation view and prior to the final coining step which semipermanently secures the upper portion to the lower portion.

FIG. 5 also shows, in this preferred embodiment of the invention, that when the first upper member 12 and the second lower member 14 are of generally equal outer diameter, then these cylindrical bodies 56 and 70 serve to form an entire assembled lamp swivel 10 in which the outer surface devines a single cylindrical body, see especially FIG. 1.

Figure 6:
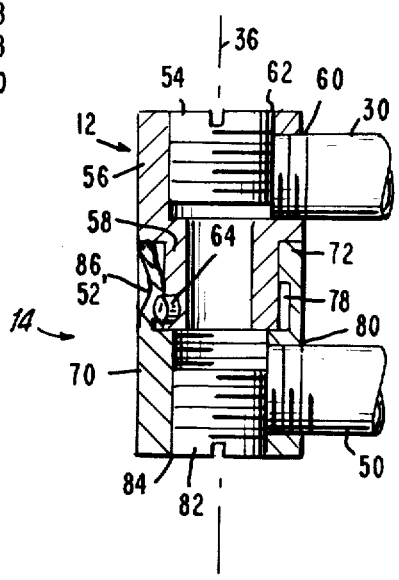
FIG. 6 shows the fully assembled and finished lamp swivel in a sectional elevation view and including the configuration, as shown, which includes the coining to secure the upper and lower portions of the swivel together.

Referring now to FIG. 6, the fully assembled and functional lamp swivel is shown. The outer surface portion 86 of the second member body 70 has been coined, i.e. stamped inwards, at and/or adjacent to the junction of the slot 76 and the groove 78. This naturally should only occur in practice after the pin means 64 has been inserted through the slot 76 and into the groove 78, followed by the rotation by manual manipulation or mechanically of the first member 12 relative to the second member 14, so as to displace the pin 64 away from the slot 76. This outer surface portion 86 must of course be coinably stampable inwards, e.g. the body member 70 will be composed (at 86) of a coinable metal, such as brass, bronze, copper, aluminum, wrought iron, or the like. Thus, the pin 64, as seen in FIG. 6, cannot be again channeled through the slot 76, and is permanently disposed in the groove 78. Consequently, as shown in FIG. 6, the first and second members 12 and 14 are permanently attached to each other, and rotatable relative to each other by less than 360 degrees.

The present lamp swivel is amenable to a rectilinear orientation of the swivel 10 and the lamp posts or rods 16 and 40, in which case ends 30 and 50 will extend and be screwed into the respective recesses 62 and 84, or vice versa. It is also feasible to extend one of the posts 16 or 40 laterally into the lamp swivel 10, while the other post extends coaxially or longitudinally into the lamp swivel 10.

It thus will be seen that there is provided a lamp swivel which achieves the various objects of the invention and which is well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby, since the embodiments of the invention particularly disclosed and described herein above is presented merely as an example of the invention. Other embodiments, forms and modifications of the invention coming within the proper scope and spirint of the appended claims, will of course, readily suggest themselves to those skilled in the art.

What is claimed is:

1. A lamp swivel mountable between a lamp base and a lamp body, said lamp body having an associated light-generating means, so that said lamp body together with its associated light-generating means may be swivelably pivoted and rotated on linear support means and about an axis, said axis being the principal axis of the lamp swivel, which comprises.

(a) a first member, said first member having a first central axis, a body disposed along said first central axis, and a dependent cylindrical extension, said extension being coaxial with said first central axis, said first central axis lying along said principal axis, said first member body being provided with means to receive one end of said linear support means, said linear support means extending from said one end to an other end connection to said lamp body, (b) pin means, said pin means extending laterally outwards from the outer surface of said extension, and (c) a second member, said second member having a second central axis and a body disposed along said second central axis, one end of said second member body having a cylindrical recess, said body recess being coaxial with said second central axis and having a diameter slightly greater than the diameter of said extension of said first member, so that said extension is contiguously insertable into said recess, the lateral surface of said recess having a slot and a circular groove, said surface slot extending from one end of said second member body to said circular groove in the surface of said recess, said groove being coaxial with said second central axis, so that when said extension is inserted into said recess, at least a portion of said first central axis is coaxial with said second central axis, said pin means being then receivable through said slot and into said groove, whereby said first member is detachably attached to said second member, and said first member is at least partially rotatable about said first central axis, while said second member either remains stationary or concomitantly rotates about said second central axis, said second central axis lying along said principal axis, said second member body being detachably attachable to means extending to said lamp base.

2. The lamp swivel of claim 1 in which the pin means comprises a pin, and the extension of the first member is provided with a lateral pocket in its outer surface, said pin being detachably insertable into said pocket.

3. The lamp swivel of claim 2 in which the pin is cylindrical and the pocket is circular, said pin being coaxially insertable into said pocket.

4. The lamp swivel of claim 1 in which the first and second members are cylindrical and coaxial.

5. The lamp swivel of claim 1 in which said linear support means and said means extending to said lamp base are each laterally detachably receivable in and attachable to their respective first or second members.

6. The lamp swivel of claim 1 in which the means in the first member body to receive one end of the linear support means, and the detachable attachment of the means extending to the lamp base, each include a threaded cylindrical recess or opening in the respective first or second member body.

7. The lamp swivel of claim 6 in which each recess or opening extends laterally into the respective first or second member body.

8. The lamp swivel of claim 1 in which the lamp body includes a lamp shade mounted to said lamp body, and light-generating means mounted to said lamp body.

9. The lamp swivel of claim 8 in which the means to generate light includes an electric light bulb and a socket, said bulb being receivable in said socket.

10. The lamp swivel of claim 1 in which the outer surface portion of the second member body at or adjacent to the junction of the slot and the groove is coinable, so that when the pin means is inserted through the slot and into the groove, and the first member is rotated relative to the second member, so as to displace the pin means away from the slot, then said outer surface portion is coinably stampable inwards, so that the pin means then cannot be again channeled through the slot and is permanently disposed in the groove, whereby said first and second members are permanently attached to each other and rotatable relative to each other by less than 360 degrees.

11. The lamp swivel of claim 1 in which each of said first and second members is provided with a central cylindrical through opening, each of said openings being coaxial with the respective member, at least a portion of each of said openings being threaded.

12. The lamp swivel of claim 1 in which the bodies of the first and second members are each cylindrical.

13. The lamp swivel of claim 12 in which the cylindrical bodies of the first and second members are of substantially equal outer diameter, so that the outer surface of the entire assembled lamp swivel defines a single cylindrical body.

* * * * *